US005355847A

United States Patent [19]

Ozeki

[11] Patent Number: 5,355,847

[45] Date of Patent: Oct. 18, 1994

[54] WATER PUMP

[75] Inventor: Hisashi Ozeki, Shizuoka, Japan

[73] Assignee: Suzuki Motor Corporation, Shizuoka, Japan

[21] Appl. No.: 166,389

[22] Filed: Dec. 13, 1993

[30] Foreign Application Priority Data

Apr. 16, 1993 [JP] Japan ..... 5-113789

[51] Int. Cl.[5] ..... F01P 5/10

[52] U.S. Cl. ..... 123/41.44; 415/176; 415/178

[58] Field of Search ..... 123/41.44, 41.47, 198 C; 415/176, 178

[56] References Cited

U.S. PATENT DOCUMENTS 5,282,446 2/1994 Whitefield ..... 123/198 C

FOREIGN PATENT DOCUMENTS 4-79932 7/1992 Japan .

*Primary Examiner*—Noah P. Kamen

*Attorney, Agent, or Firm*—Flynn, Thiel, Boutell & Tanis

[57] ABSTRACT

An internal chamber of a water pump is extended to a position so as to radially surround at least parts of the water pump bearing and water drain hole. Ribs may be provided in the internal chamber to reinforce the water pump casing.

5 Claims, 6 Drawing Sheets

WATER PUMP

FIELD OF THE INVENTION

The invention relates to a water pump and, more particularly, to a water pump formed so as to reduce thermal influence of lubricating oil which flows in a lubricating passage oil formed around a water pump casing.

BACKGROUND OF THE INVENTION

In an engine of a motorcycle, an outboard motor, or a vehicle, there are known engines in which cylinders are serially arranged, in which cylinders are arranged so as to face each other, in which each cylinder bank is arranged in a V-letter shape, and the like.

The V-type engine is typically constructed by installing first and second cylinder heads onto first and second cylinder banks of the cylinder block. First and second cylinder head covers are attached to the first and second cylinder heads. A crankshaft which extends in the longitudinal direction of the engine is rotatably provided at a central portion of the cylinder block. Auxiliary apparatuses such as a cam shaft of a valve gear system, a water pump, and the like are driven by the crankshaft.

Such a water pump is disclosed in JP-U-4-79932. According to the water pump disclosed in this publication, an impeller is fixed to one end of a pump shaft which is pivotally attached to a pump housing through a bearing, a sealing device is provided between the impeller and the bearing, upper and lower side drain passages communicate a hollow chamber between the bearing and the sealing device with the outside of the pump housing, a dust cover faces an opening on the hollow chamber side of at least the upper side drain passage, and a concave portion is formed in the dust cover.

With this conventional water pump, as shown in FIG. 10, the water pump 154 is attached to a cylinder block 104 of a V-type engine 102. A timing chain (not shown) is interposed through a timing chain cover 152 around a casing 158 of the water pump 154. The timing chain cover 152 is arranged around the casing 158 through a seal member 160 comprising an O ring. A timing chain line exists between the timing chain cover 152 and the cylinder-block 104. A lubricating oil passage (not shown) is formed and lubricating oil flows in the lubricating oil passage.

The casing 158 has a hub or housing portion 168 for a water pump bearing 170, and the portions near water drain hole portions 174-1 and 174-2 are directly bleached to the lubricating oil. Thus, when the water drain hole portions 174-1 and 174-2 are thermally influenced by the lubricating oil and are set to high temperatures and cooling water leaks from mechanical seal 166, a component in, for example, an LLC (Long Life Coolant) which is used as a cooling water is precipitated by the high temperature and is deposited and chokes the water drain hole portions. The cooling water may then enter the water pump bearing so that the life of the bearing is reduced, and this is practically disadvantageous.

As also shown in FIG. 10, the water pump bearing 170 is inserted with pressure (i.e. a press fit) into the housing portion 168 of the casing 158. In the case where the coefficient of thermal expansion of the material of the casing 158 is larger than that of the material forming the outer race 184 of the bearing 170, when the heat of the lubricating oil acts on the housing portion 168 of the casing 158, the inner diameter of the housing portion 168 increases, and a magnitude of the pressure fit of the bearing 170 within the housing decreases, so that there is an inconvenience in that the bearing 170 may drop out. There are also inconveniences in that a holder 188, the lip seal 172, grease, etc., as component parts of the water pump bearing 170 itself, are also deteriorated by the heat. The life of the bearing is thus reduced, and this is practically and economically disadvantageous.

To eliminate the above inconveniences, according to the invention, there is provided a water pump which is arranged in a cylinder block of an engine and forms a passage for lubricating oil around a water pump casing which is covered. A water drain hole portion is formed around the water pump casing, a water pump bearing is provided on the inside of the water pump casing, and an inner chamber of the water pump is extended to a position at which it surrounds at least parts of the water pump bearing and the water drain hole portion so as to reduce the thermal influence of the lubricating oil on the water pump bearing or water drain hole portion.

There is also provided a water pump which is arranged in a cylinder block of an engine and forms a passage for lubricating oil around a water pump casing which is covered, wherein a water drain hole portion is formed around the water pump casing, a water pump bearing is provided on the inside of the water pump casing, an inner chamber of the water pump is extended to a position at which it surrounds at least parts of the water pump bearing and the water drain hole portions so as to reduce thermal influence of the lubricating oil on the water pump bearing or water drain hole portion, and ribs for reinforcement are provided in the inner chamber of the water pump casing.

There is also provided a water pump which is arranged in a cylinder block of a V-type engine such that first and second cylinder heads are installed in the cylinder block and first and second cylinder banks are arranged in a V-shape and forms a passage for lubricating oil around a water pump casing which is covered, wherein a water drain hole portion is provided for the water pump casing, a water pump bearing is provided on the inside of the water pump casing, and an inner chamber of the water pump is extended to a position such that it radially surrounds at least parts of the water pump bearing and the water drain hole portion so as to reduce thermal influence of the lubricating oil on the water pump bearing and the water drain hole portion.

There is further provided a water pump which is arranged in a cylinder block of a V-type engine such that first and second cylinder heads are installed in the cylinder block and first and second cylinder banks are arranged in a V-shape and forms a passage for lubricating oil around a water pump casing which is covered, wherein a water drain hole portion is provided for the water pump casing, a water pump bearing is provided on the inside of the water pump casing, an inner chamber of the water pump is extended to a position such that it radially surrounds at least parts of the water pump bearing and the water drain hole portion so as to reduce thermal influence of the lubricating oil on the water pump bearing and the water drain hole portion, and ribs for reinforcement are provided in the inner chamber of the water pump casing.

According to the invention as mentioned above, the inner chamber of the water pump extends up to a position such that it surrounds at least parts of the water pump bearing and the water drain hole portion to reduce the thermal influence by the lubricating oil on the water pump bearing and the water drain hole portion. The ribs for reinforcement are provided in the inner chamber of the water pump casing, hereby improving the rigidity of the casing.

DETAILED DESCRIPTION

Figure 1:
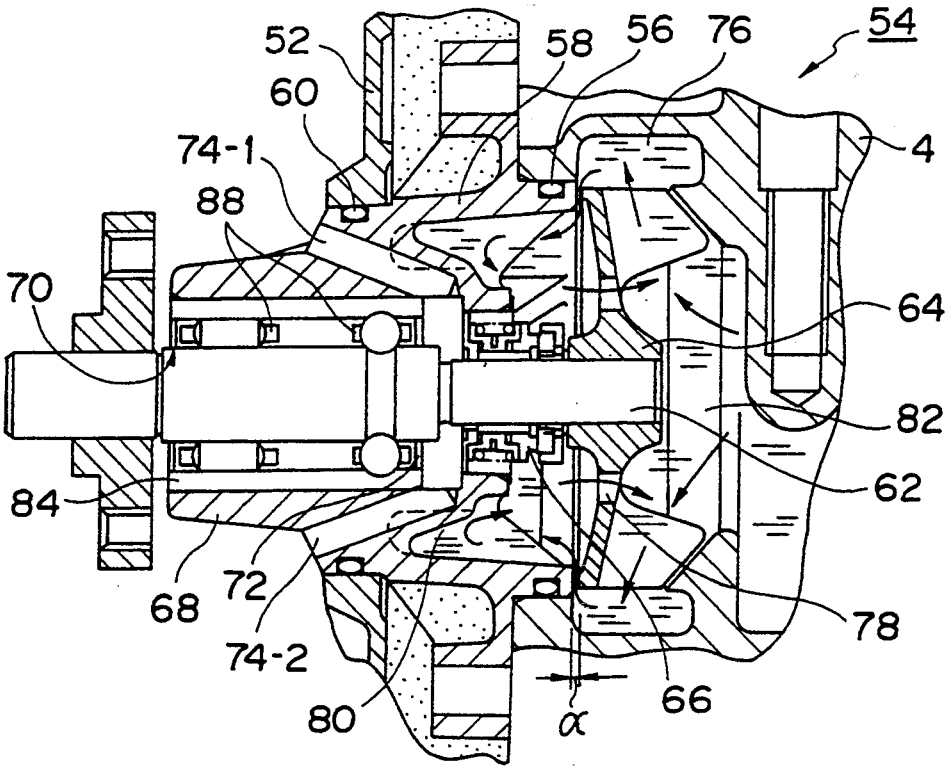
FIG. 1 is a schematic cross sectional view of a water pump portion showing an embodiment of the invention.
Figure 2:
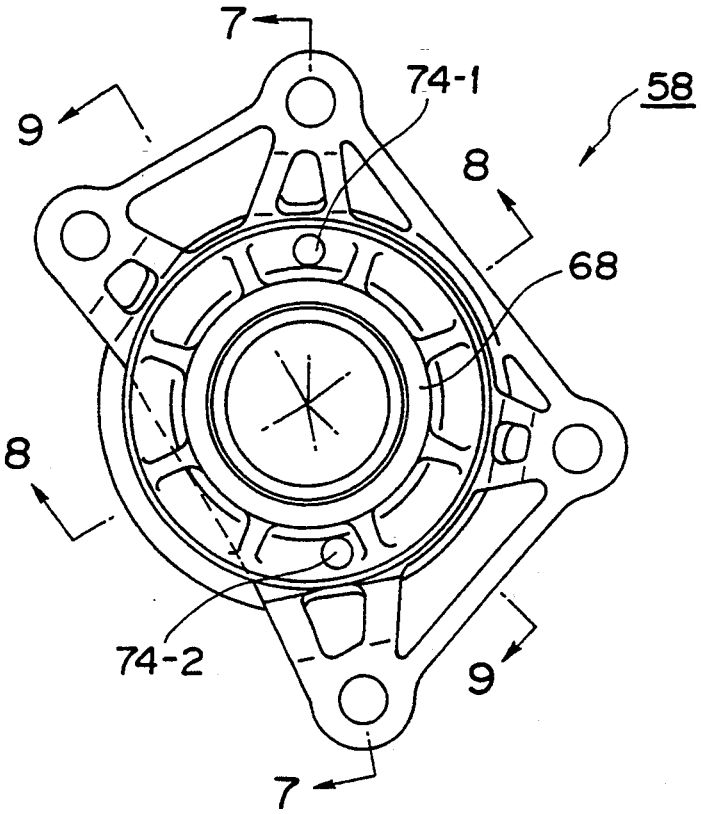
FIG. 2 is a front view of a water pump.
Figure 3:
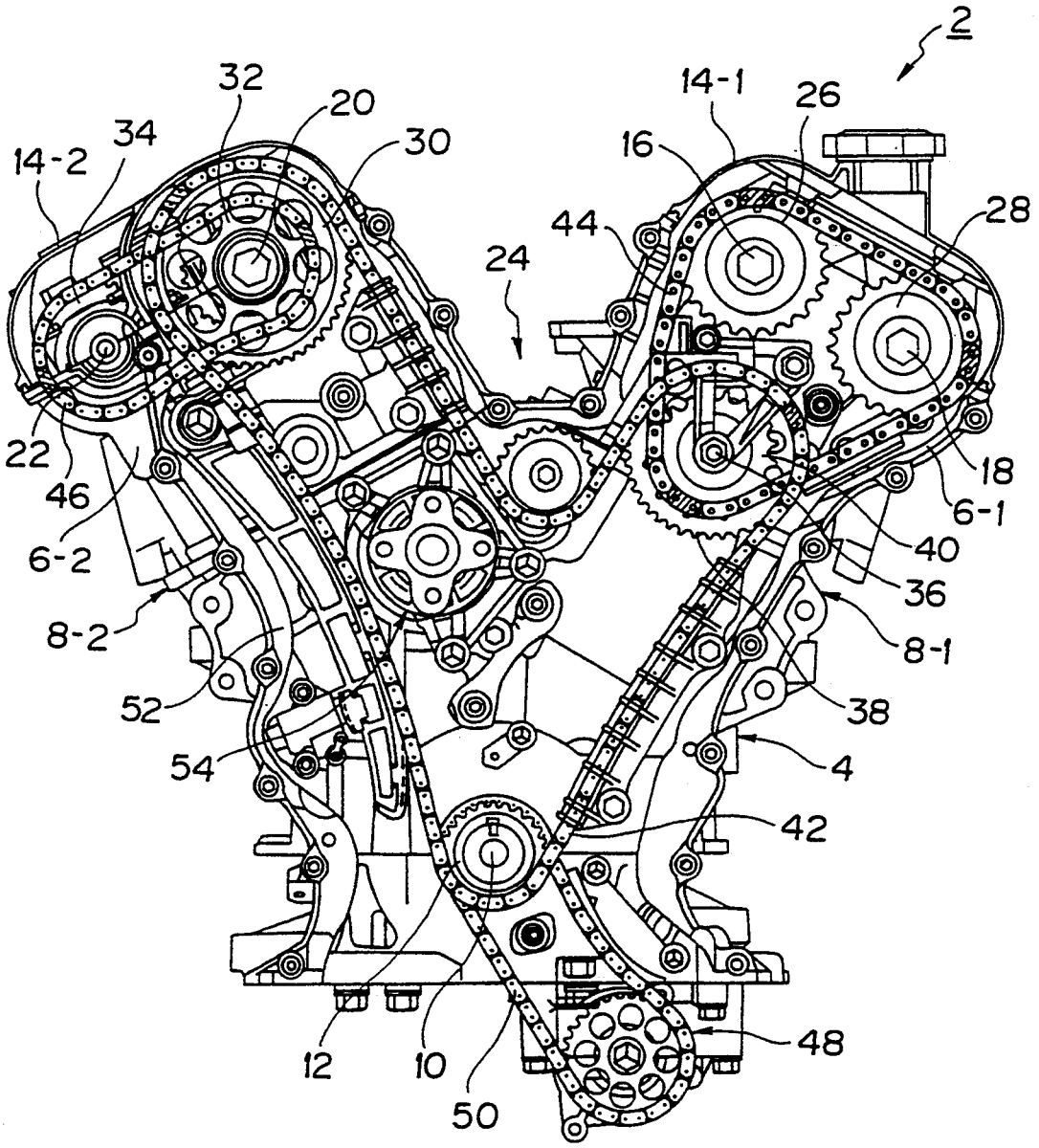
FIG. 3 is a front view of a V-type engine when a timing chain is mounted.

An embodiment of the invention will now be described in detail hereinbelow with reference to FIGS. 1 to 9.

In FIGS. 3 to 5, 2 denotes an engine such as a V-type engine; 4 a cylinder block; 6-1 and 6-2 first and second cylinder heads; and 8-1 and 8-2 first and second cylinder banks. In the V-type engine 2, the first and second cylinder heads 6-1 and 6-2 are installed on the cylinder block 4 and the first and second cylinder banks 8-1 and 8-2 are arranged in a V-shape.

A crankshaft 10 is axially supported on the cylinder block 4 in the longitudinal direction by a bearing cap (not shown). An oil pan (not shown) is attached to the lower portion of the block. First and second cylinders or bores (not shown) are provided in the cylinder block 4 and first and second pistons (not shown) are slidable therein, with the first and second pistons being connected to the crankshaft 10 by conventional connecting rods (not shown), respectively.

A sprocket 12 is typically attached to one end portion of the crankshaft 10.

A pair of cam shafts, namely a first cam shaft 16 for an intake valve and a first cam shaft 18 for an exhaust valve, are respectively arranged in a first head cover 14-1 of the first Cylinder head 6-1. A pair of cam shafts, namely a second cam shaft 20 for an intake valve and a second cam shaft 22 for an exhaust valve, are respectively arranged in a second head cover 14-2 of the second cylinder head 6-2.

The first and second cam shafts 16 and 20 for the intake valves are respectively positioned closely adjacent but on opposite sides of a V-shaped space 24 which is defined between the first and second cylinder heads 6-1 and 6-2.

Sprockets 26 and 28 of small diameters are, mounted at one end of the first cam shafts 16 and 18, respectively.

A sprocket 30 of large diameter and a coaxial small-diameter sprocket 32 having the same shape as that of the small-diameter sprockets 26 and 28 are arranged at one end of the second cam shaft 20. A small-diameter sprocket 34 having the same shape as that of the small-diameter sprockets 26, 28, and 30 is arranged at one end of the second cam shaft 22.

An intermediate shaft 36 is arranged between the pair of cam shafts 16 and 18 and the crankshaft 10. A sprocket 38 of large diameter and a sprocket 40 of small diameter are coaxially arranged at one end of the intermediate shaft 36.

The large-diameter sprocket 30 of second cam shaft 20, the large-diameter sprocket 38 of the intermediate shaft 36, and the sprocket 12 of the crankshaft 10 are connected by a first timing chain 42. The small-diameter sprockets 26 and 28 of the two cam shafts 16, 18 and the small-diameter sprocket 40 of the intermediate shaft 36 are connected by a second timing chain 44. The small-diameter sprockets 32 and 34 of the two cam shafts 20 and 22 are connected by a third timing chain 46. Further, the crankshaft 10 and oil pump 48 are connected by a fourth timing chain 50.

Figure 4:
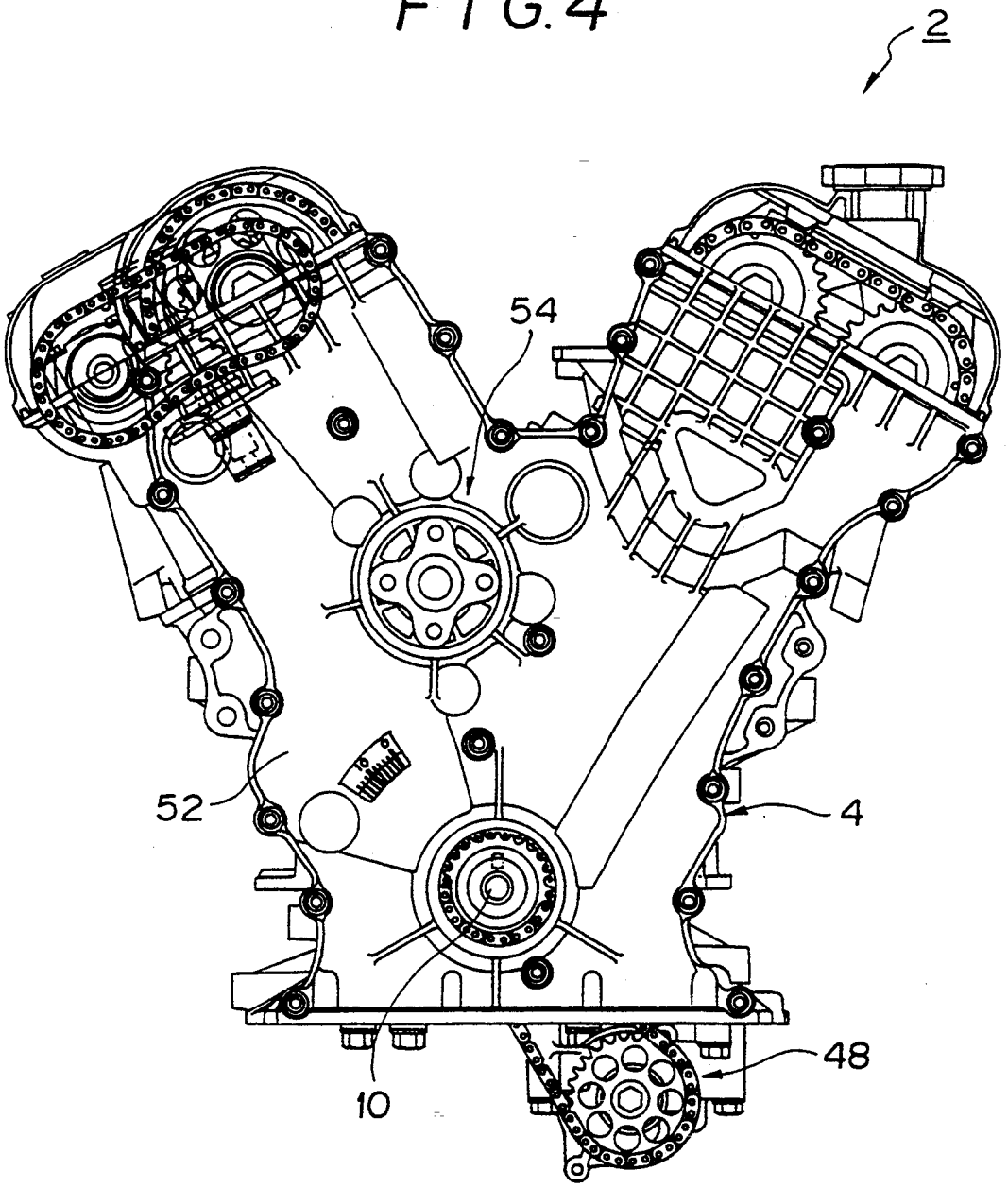
FIG. 4 is a front view of the V-type engine when a timing chain cover is mounted.
Figure 5:
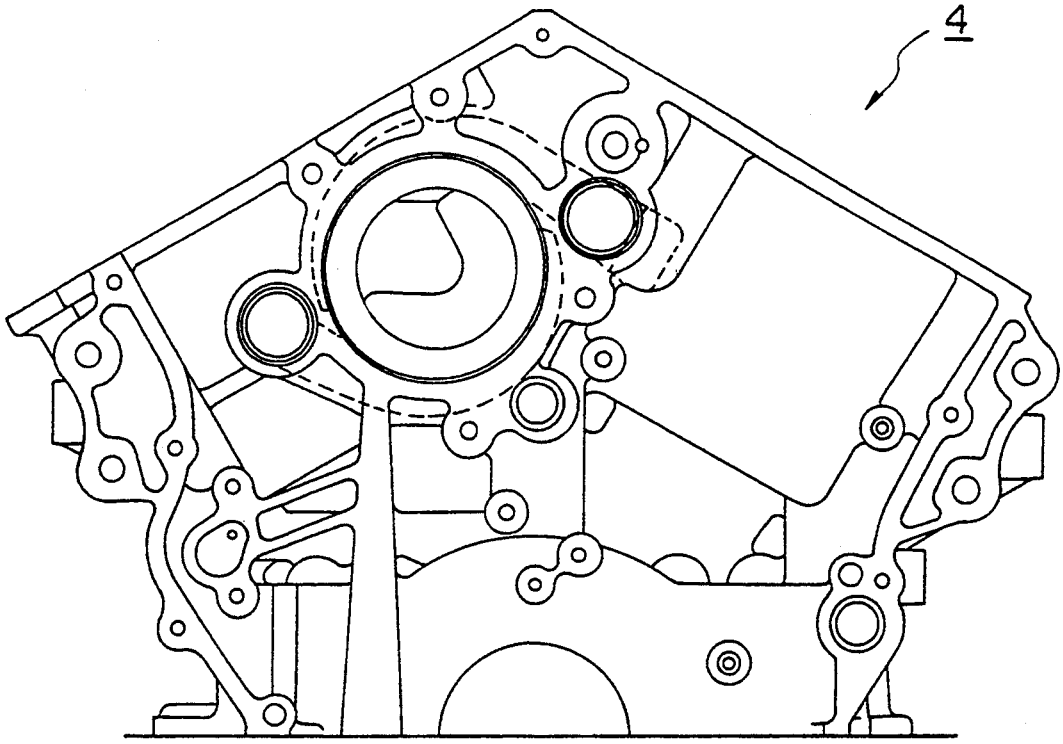
FIG. 5 is a front view of a cylinder block.

The first to fourth timing chains 42, 44, 46, and 50 are covered by a timing chain cover 52 as shown in FIG. 4.

A water pump 54 is arranged between the cylinder block 4 of the V-type engine 2 and the timing chain cover 52, and at the position which is slightly deviated toward the second cylinder head 6-2 side. A crank pulley (not shown) is provided for the crankshaft 10. A water pump pulley (not shown) is provided for the water pump 54. The crank pulley and the water pump pulley are engaged with a driving belt (not shown), as is conventional.

As shown in FIG. 1, water pump casing 58 is attached to the cylinder block 4 through a sealing member 56 such as an O ring, and the timing chain cover 52 is attached to the water pump 54 from the outside of the water pump casing 58 through a sealing member 60 made as an O ring.

An impeller 64 is attached to one end of a pump shaft 62 of the water pump 54. A mechanical seal 66 is arranged on the inside of the water pump casing 58, thereby allowing the impeller 64 to be located between the cylinder block 4 and the water pump casing 58. The water pump casing 58 is extended in the outside direction, thereby forming a projecting sleeve-like housing portion 68. A bearing 70 is arranged on the inside of the casing 58 between the housing portion 68 and the pump shaft 62. A driving pulley for the water pump is arranged at the outer end of the pump shaft 62.

Two water drain holes 74-1 and 74-2 are formed in the water pump casing 58 adjacent the inner end of hub portion 68 so as to communicate with the region between a lip seal 70 and the mechanical seal 66. These holes 74-1 and 74-2 preferably communicate with the inner end of the bearing closely adjacent the seal 66.

As shown in FIG. 1, a timing chain line or space exists between the timing chain cover 52 and the cylinder block 4, and a lubricating oil passage (not shown) is formed in which lubricating oil flows.

Reference number 76 of FIG. 1 denotes an eddy chamber of which is formed in the cylinder block 4 and the outer portion of which serves as a high pressure cooling water passage; 78 is a pressure balance hole which is-formed in the impeller 64; 80 is an internal chamber which communicates with a low pressure inlet 82 of the eddy chamber 76 by the balance hole 78 and also communicates with the inlet 82 by a gap e between the impeller 64 and the casing 58; and 84 is an outer race of the water pump bearing 70.

The internal annular chamber 80 as defined within the casing 58 of the water pump 54 is extended axially outwardly to a position so as to radially surround at least parts of the water pump bearing 70 and the housing portions defining the water drain holes 74-1 and 74-2 so as to reduce the thermal influence of the lubricating oil on the water pump bearing 70 and the water drain hole portions 74-1 and 74-2.

Explaining in detail, when the internal chamber 80 is foraged in the inside of the water pump casing 58, as shown in FIGS. 1 and 7 to 9, the internal chamber 80 is extended from the casing end portion located between the timing chain cover 52 and the cylinder block 4 outwardly to a position adjacent the water pump bearing 70 or water drain hole portions 74-1 and 74-2, thereby radially surrounding at least parts of the water pump bearing 70 and the water drain hole portions 74-1 and 74-2. The thermal influence of the lubricating oil from the timing chain line side is thus shut off or isolated from the bearing 70 and hole portions 74-1 and 74-2 by the internal chamber 80 and the coolant that flows therein.

The internal chamber 80 is axially extended and the inside surface area of the casing 58 is increased, thereby improving cooling efficiency of the casing.

Figure 6:
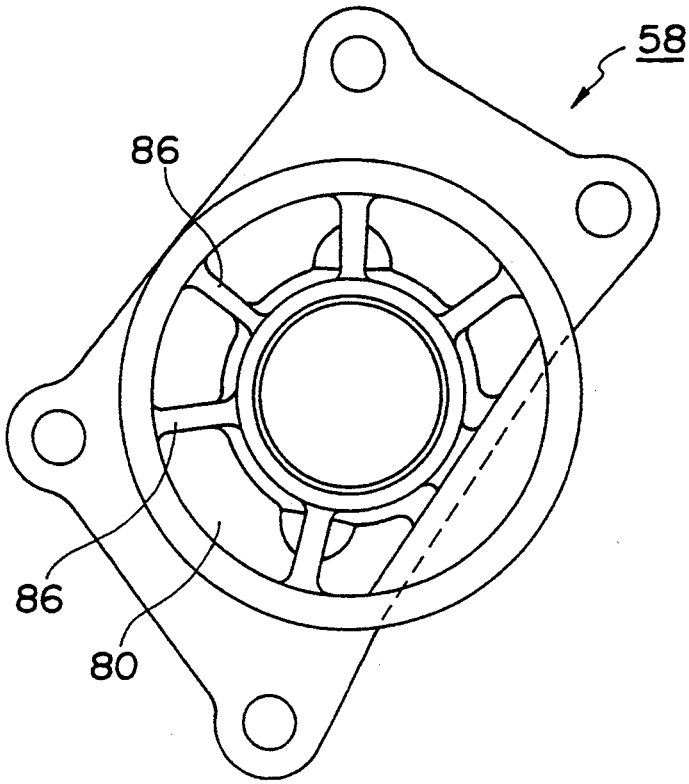
FIG. 6 is a rear view of the water pump.
Figure 7:
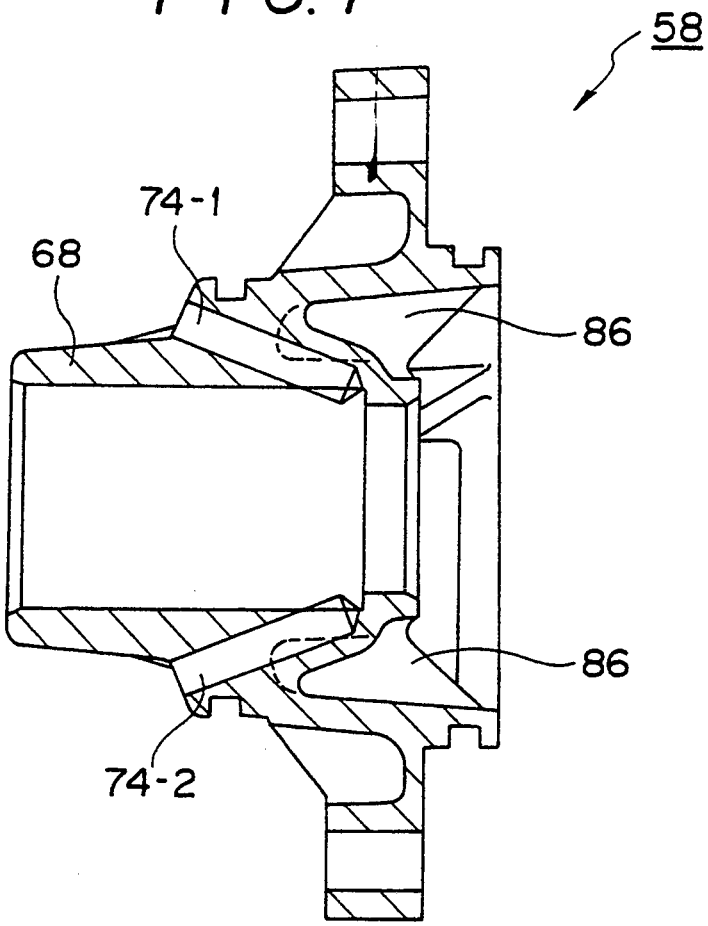
FIG. 7 is a cross sectional view taken along line 7—7 in FIG. 2.
Figure 8:
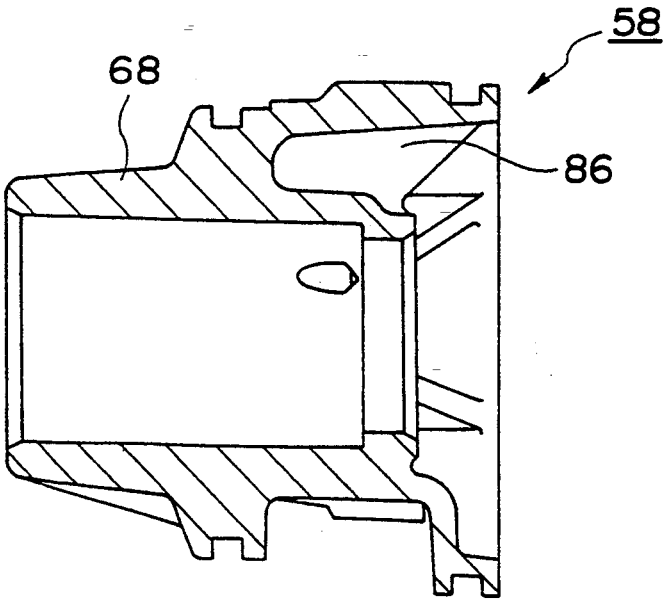
FIG. 8 is a cross sectional view taken along line 8—8 in FIG. 2.
Figure 9:
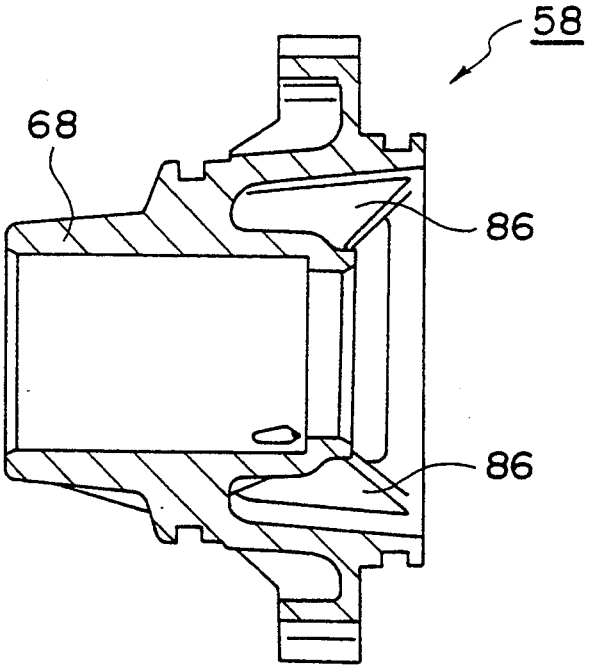
FIG. 9 is a cross sectional view taken along the line 9—9 in FIG. 2.
Figure 10:
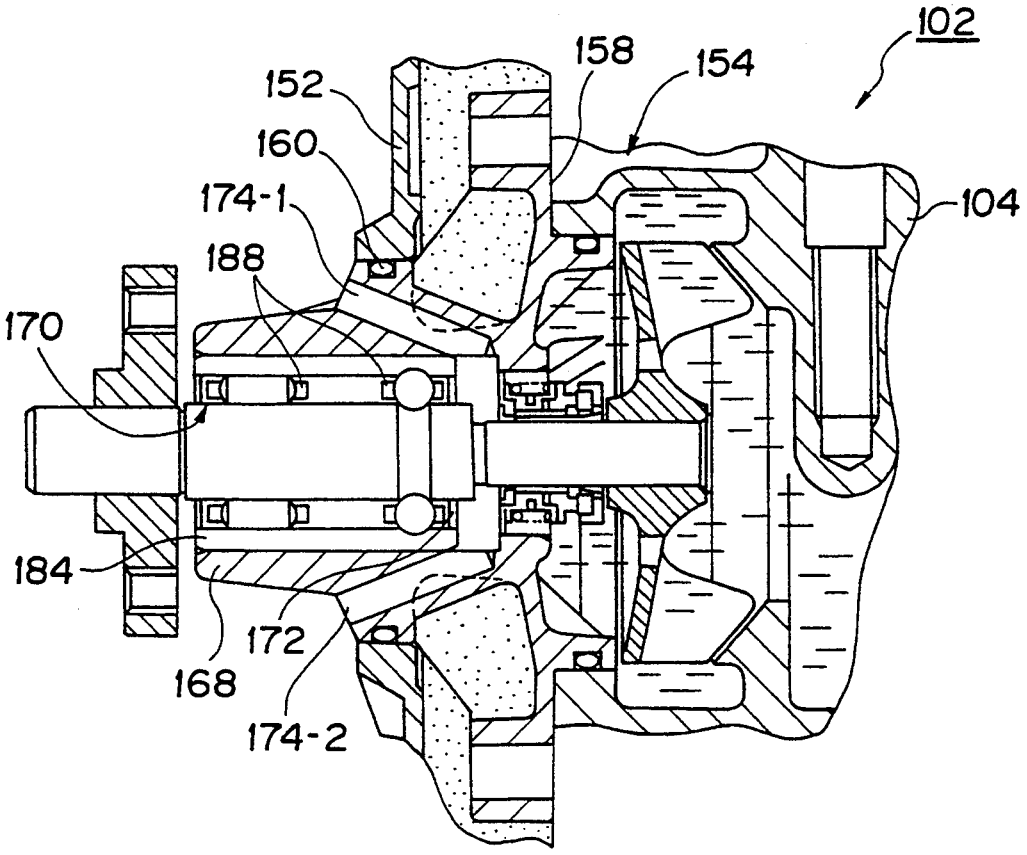
FIG. 10 PRIOR ART
FIG. 10 is a schematic cross sectional view of a water pump portion indicative of the prior art.

Further, angularly spaced ribs 86 are provided in the internal chamber 80 and connect to the water pump casing 58 for reinforcement thereof. That is, as shown in FIGS. 6 and 7 for example, five reinforcing ribs 86 are provided at regular angular intervals in the internal chamber 80 whose inside surface area of the casing is enlarged.

Reference numeral 88 denotes a holder as a component part of the water pump bearing 70.

The operation will now be described.

When the water pump 54 is driven, the cooling water flowing from the inlet 82 is led into the outer portion of eddy chamber 76 by the impeller 64, as shown by arrows in FIG. 1. A part of the cooling water flows into the internal chamber 80 through the gap $\alpha$ between the impeller 64 and the water pump casing 58. The cooling water in the internal chamber 80 cools the water pump casing 58 and the mechanical seal 66 and is returned to the inlet side 82 through the balance hole 78 by differential pressure.

Thus, the internal chamber 80 is axially extended to locations near to (and partially radially surrounding) the water drain hole portions 74-1 and 74-2, whereby the cooling water in the internal chamber 80 prevents the water drain hole portions 74-1 and 74-2 from being thermally influenced (i.e. heated) by the lubricating oil. The component in the LLC (Long Life Coolant) as a cooling water which leaks from the mechanical seal 66 is thus not precipitated by the heat and deposited. It is thus possible to prevent the water drain hole portions 74-1 and 74-2 from being choked with deposits. This thus prevents or minimizes cooling water to entering the water pump bearing 70, whereby the life of the water pump bearing 70 can be prolonged as is practically advantageous.

As shown in FIG. 1, by inserting the water pump bearing 70 into the housing portion 68 of the water pump casing 58 with a press fit, for example, even in the case where the thermal coefficient of expansion of the material of the water pump casing 58 is larger than that of the material forming the outer race 84 of the water pump bearing 70, the temperature of the cooling water acts on the housing portion 68 of the water pump casing 58 rather than of the oil temperature. A press fit of the pump bearing 70 is thus not reduced so that the bearing 70 is less likely to fall out. Deterioration of the holder 88, lip seal 72, grease, or the like as a component part of the water pump bearing 70 itself, as caused by heat, is also reduced.

Further, the temperatures of the two elastomeric sealing members 56 and 60 can also be reduced as compared with conventional ones. A good sealing performance can be obtained.

Further, the water pump casing 58 has a shape such that it can be easily pulled out from a mold as compared with the conventional one, so that productivity can be improved.

Since the lubricating oil flowing exteriorly around the water pump casing 58 can be cooled by the cooling water in the internal chamber 80, the oil temperature can be reduced so as to contribute to improvement in the lubricating and cooling functions of the lubricating oil.

Further, since the inside surface area of the casing can be enlarged by extending the internal chamber 80 axially and radially if necessary, the inflow amount of cooling water into the internal chamber 80 increases and the cooling efficiency of the casing is improved.

Moreover, since the reinforcing ribs 86 are provided in the internal chamber 80 whose inside surface area is enlarged, the rigidity of the water pump casing 58 is improved.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A water pump is arranged in a cylinder block of an engine and forms a passage for lubricating oil around a water pump casing which is covered, wherein a water drain hole portion is formed around the water pump casing, a water pump bearing is provided on the inside of the water pump casing, and an inner chamber of the water pump is extended to a position at which it radially surrounds at least parts of the water pump bearing and the water drain hole portion to reduce thermal influence of the lubricating oil on the water pump bearing or water drain hole portion.

2. A water pump according to claim 1, wherein reinforcement ribs are provided in the inner chamber of the water pump casing.

3. A water pump which is arranged in a cylinder block of a V-type engine such that first and second cylinder heads are installed in the cylinder block and first and second cylinder banks are arranged in a V-shape and forms a passage for a lubricating oil around a water pump casing which is covered, wherein a water drain hole portion is provided for the water pump casing, a water pump bearing is provided on the inside of the water pump casing, and an inner chamber of the water pump is extended to a position such that it radially surrounds at least parts of the water pump bearing and the water drain hole portion to reduce thermal influence of the lubricating oil on the water pump bearing and the water drain hole portion.

4. A water pump according to claim 3, wherein reinforcement ribs are provided in the inner chamber of the water pump casing.

5. In a V-type engine having a water pump secured to one end of said engine and protruding outwardly through and sealingly positioned within an opening provided in an end cover secured to the engine, the water pump including a casing which projects through and is sealingly engaged within the cover opening, the casing having opening means extending therethrough with a pump shaft being rotatably supported within and projecting coaxially through the opening means and supported on the casing by bearing means disposed adjacent an outer end of said opening means, a pump impeller secured to the shaft adjacent an inner end thereof so as to be disposed behind the engine cover, and a seal structure disposed axially between the bearing means and impeller and cooperating between the shaft and pump casing, and a water drain hole extending outwardly through said casing with an inner end of said drain hole communicating with said opening means at a location generally between said seal arrangement and said bearing means, the improvement comprising an annular water coolant chamber formed in said casing between radially inner and outer walls thereof, said annular coolant chamber being disposed generally in surrounding relationship to said seal arrangement with said seal arrangement being supported on said radially inner annular wall, said annular coolant chamber at one axial end thereof communicating directly with a chamber in which the pump impeller is positioned, said annular chamber projecting outwardly in the opposite axial direction so as to axially overlap and at least partially radially surround said bearing means.

* * * * *